United States Patent [19]

Smith

[11] Patent Number: 4,695,010

[45] Date of Patent: Sep. 22, 1987

[54] LEVELWIND MECHANISM

[75] Inventor: Glenn S. Smith, Issaquah, Wash.

[73] Assignee: Beebe International, Inc., Seattle, Wash.

[21] Appl. No.: 873,506

[22] Filed: Jun. 12, 1986

[51] Int. Cl.[4] ..... B65H 54/28

[52] U.S. Cl. ..... 242/158 R; 242/157.1

[58] Field of Search ..... 242/158 R, 158 B, 158 F, 242/158.2, 158.4 R, 157.1, 25 R

[56] References Cited

U.S. PATENT DOCUMENTS

| | | | |
|---|---|---|---|
| 490,984 | 1/1893 | Pine . | |
| 1,625,432 | 4/1927 | Sager | 242/158.4 R |
| 2,626,765 | 1/1953 | Biddison | 242/158 R |
| 2,660,382 | 11/1953 | Wilson | 242/158 R |
| 3,031,153 | 4/1962 | Attwood et al. | 242/158 R |
| 3,240,428 | 3/1966 | Baselice | 242/158.4 R X |
| 3,319,070 | 5/1967 | Schneider | 250/222 |
| 3,456,899 | 7/1969 | Smith et al. | 242/158 R |
| 3,552,682 | 1/1971 | Walsh | 242/158.3 |
| 3,815,846 | 6/1974 | Biewer | 242/158 R |
| 3,963,186 | 6/1976 | Van den Aa | 242/158 R X |
| 4,087,060 | 5/1978 | Laky et al. | 242/158 R |
| 4,535,955 | 8/1985 | Custer | 242/158 R |
| 4,541,584 | 9/1985 | Rivinius | 242/158 R |

FOREIGN PATENT DOCUMENTS

| | | | |
|---|---|---|---|
| 1042614 | 6/1953 | France | 242/158 R |
| 1126871 | 7/1956 | France | 242/158 R |
| 1194825 | 6/1970 | United Kingdom | 242/158 F |

*Primary Examiner*—Stanley N. Gilreath

*Attorney, Agent, or Firm*—Christensen, O'Connor, Johnson & Kindness

[57] ABSTRACT

A levelwind mechanism (11) for controlling the fleet angle of a cable as the cable (15) is spooled onto a winch drum (13) is disclosed. The levelwind mechanism (11) includes a horizontally oriented square guide bar (21) mounted parallel to the axis of rotation of the drum. Located on the lower surface of the guide bar is an elongate rack (23). Encircling the guide bar is a frame (25) that supports a fleet angle sensor (107), cable guide rollers (97), an air motor (47) and a gear train (49). The gear train (49) couples the air motor (47) to the rack (23) such that energization of the air motor (47) causes the frame (25) to slide along the rack (23). When the fleet angle sensor (107) senses a fleet angle exceeding a predetermined value, the air motor (47) is energized to rotate the gears of the gear train (49) in the direction that reduces the fleet angle to an acceptable value.

11 Claims, 7 Drawing Figures

LEVELWIND MECHANISM

TECHNICAL AREA

This invention relates to winches and, more particularly, levelwind mechanisms for controlling the fleet angle of cable as cable is spooled onto a winch drum.

BACKGROUND OF THE INVENTION

Winches are used extensively in hauling, pulling and hoisting machines for raising and lowering loads, particularly heavy loads. For example, they are commonly used in well drilling rigs to raise and lower drilling tools and/or sensing instruments. Winches include a drum that supports a spool of cable that runs to the load, usually through one or more sheaves. The cable is taken in and payed out by rotating the drum. Depending upon the environment in which the winch is to be used, the cable may be formed of steel or rope. In some instances, electrical signal conductors may form part of the cable.

As the cable is taken in it is wound (e.g., spooled) onto the drum in multilayers. Because cable is difficult to evenly spool, most winches include a spooling mechanism designed to control the fleet angle of the cable as cable is spooled onto the drum. In the past, most spooling mechanisms have been directly coupled to the winch drum such that the cable guide rollers of the spooling mechanism move in synchronism with the drum as the drum rotates. In the past this has caused a problem. Because cable varies in diameter and because cable diameter changes with use, very small timing errors occur between drum rotation and spooling mechanism movement. Because small timing errors accumulate, they become magnified, resulting in uneven spooling. Uneven spooling is undesirable because it causes more cable wear than even spooling. Uneven spooling is also undesirable because it is unsafe.

While proposals have been made to avoid uneven spooling, in general, they have not been entirely satisfactory, particularly in winches designed to raise the heavy loads associated with modern oil well rigs and ships. For example, U.S. Pat. No. 2,660,382, entitled "Levelwinding Device" by J. H. Wilson, describes a levelwind mechanism whose movement is dependent upon changes in fleet angle. Fleet angle changes are sensed and utilized to control the rotation of a sprocket that engages a chain to reduce fleet angle. One major disadvantage of this device is the fact that sprocket/-chain mechanisms lack structural strength. Thus, while a device of the type described in U.S. Pat. No. 2,660,382 may be useful in connection with lightweight cable hoists, it is not suitable for use in mechanisms designed to hoist extremely heavy loads. Another disadvantage is the need for a carriage to move the levelwind mechanism perpendicular to the axis of rotation of the drum as the cable is taken in and payed out. In addition to making the overall device over complicated, the carriage has lower structural strength than a system that avoids the need for such a carriage.

This invention is directed to a levelwind mechanism that overcomes the foregoing and other problems of prior levelwind mechanisms, particularly levelwind mechanisms intended for use with hoists designed to raise heavy loads.

SUMMARY OF THE INVENTION

In accordance with this invention, a levelwind mechanism for controlling the fleet angle of a cable as the cable is spooled onto a winch drum is provided. The levelwind mechanism includes a fixed position horizontal support mounted parallel to the axis of rotation of the winch drum and a frame slidably mounted on the horizontal support. The frame supports a fleet angle sensor, cable guide rollers, a motor and a coupling mechanism for coupling the shaft of the motor to the horizontal support. The coupling mechanism includes a gear train connected at one end to the shaft of the motor and a pinion gear located at the other end. The pinion gear engages a rack that is mounted on the horizontal support. The gear train couples the motor to the rack such that energization of the motor causes the frame to slide along the rack. The fleet angle sensor controls the energization of the motor such that the motor is energized to rotate the gear train in the direction that reduces the fleet angle when the fleet angle exceeds a predetermined value.

In accordance with further aspects of this invention, the horizontal support is a guide bar having a rectangular cross-sectional shape and the rack is positioned on one surface of the guide bar. Further, the frame encircles the guide bar.

In accordance with other aspects of this invention, the fleet angle sensor includes a plate and a pair of fleet angle fingers mounted on the plate and positioned between the cable guide rollers and the winch drum. The cable passes through the fleet angle fingers, as well as through the cable rollers, and the plate is movable in response to cable pressure applied transversely against the fleet angle rollers. The plate is coupled to the motor such that the position of the plate controls the application of power to the motor and the direction of rotation of the motor shaft. Thus, the fleet angle as sensed by transverse pressure against fleet angle fingers, controls the energization of the motor and, thus, movement of the frame and the position of cable rollers.

In accordance with yet further aspects of this invention, both the fleet angle fingers and the cable rollers are relatively long. As a result, the cable remains in contact with the fingers and the rollers as the cable is spooled even though the guide bar remains fixed.

As will be readily appreciated from the foregoing description, the invention provides a levelwind mechanism that automatically controls the fleet angle of a cable as it is spooled onto a winch drum. Rather than being coupled to the winch drum for movement in response to drum rotation, movement of the cable guide rollers of the levelwind mechanism is controlled by the actual fleet angle. Consequently, the small timing errors cannot accumulate and cause problems. Because timing errors cannot accumulate, spooling is even. Further, because the invention utilizes a gear train and a rack-and-pinion mechanism for controlling the position of the frame that supports the cable guide rollers, the invention is ideally suited for use in heavy industrial and commercial environments. This use is enhanced because the long fleet angle and cable rollers allow the guide bar to remain fixed, if desired.

BRIEF DESCRIPTION OF THE DRAWINGS

The foregoing and other features and advantages of the present invention will become better understood by reference to the following detailed description when taken in conjunction with the accompanying drawings wherein.

DESCRIPTION OF THE PREFERRED EMBODIMENT

Figure 1:
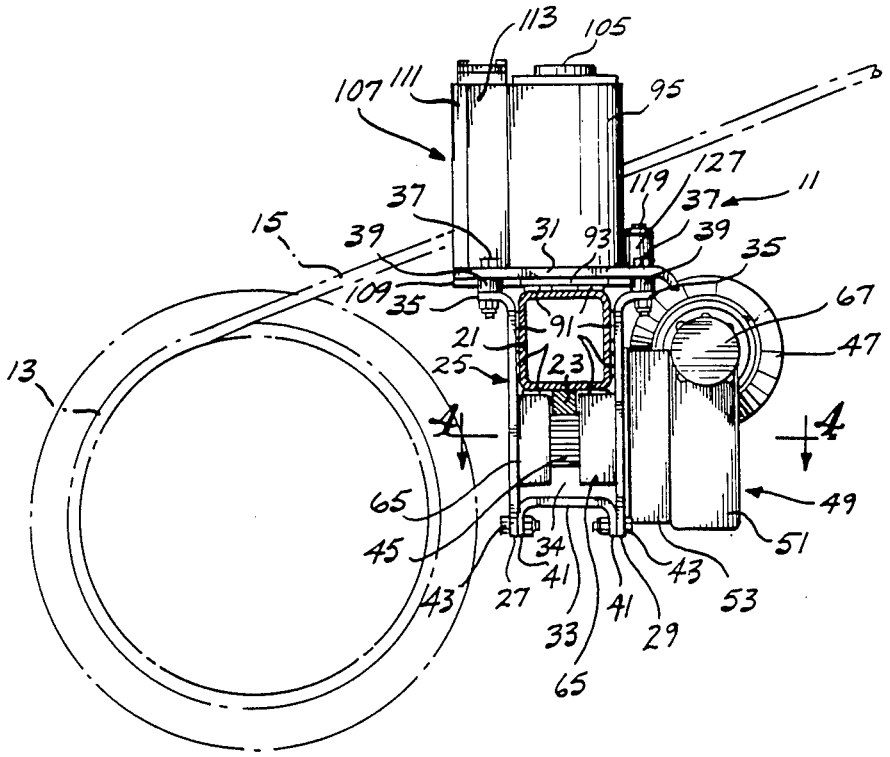
FIG. 1 is an end view of a levelwind mechanism formed in accordance with the invention.
Figure 2:
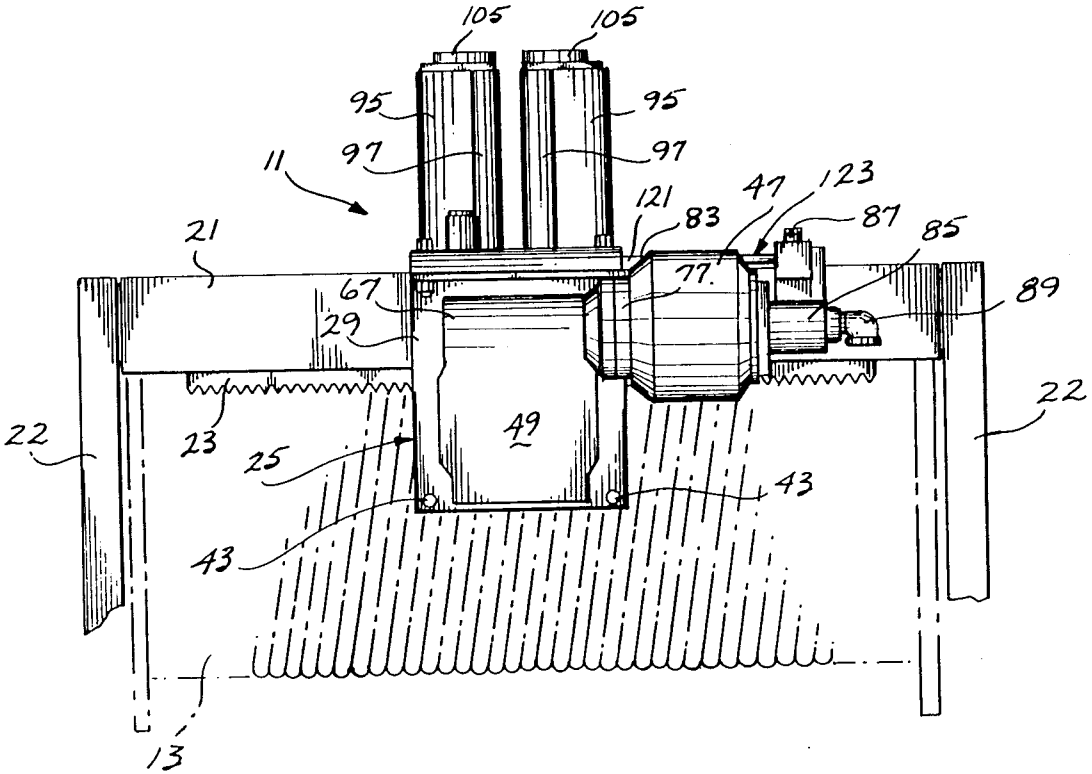
FIG. 2 is a front view of the levelwind mechanism illustrated in FIG. 1.
Figure 3:
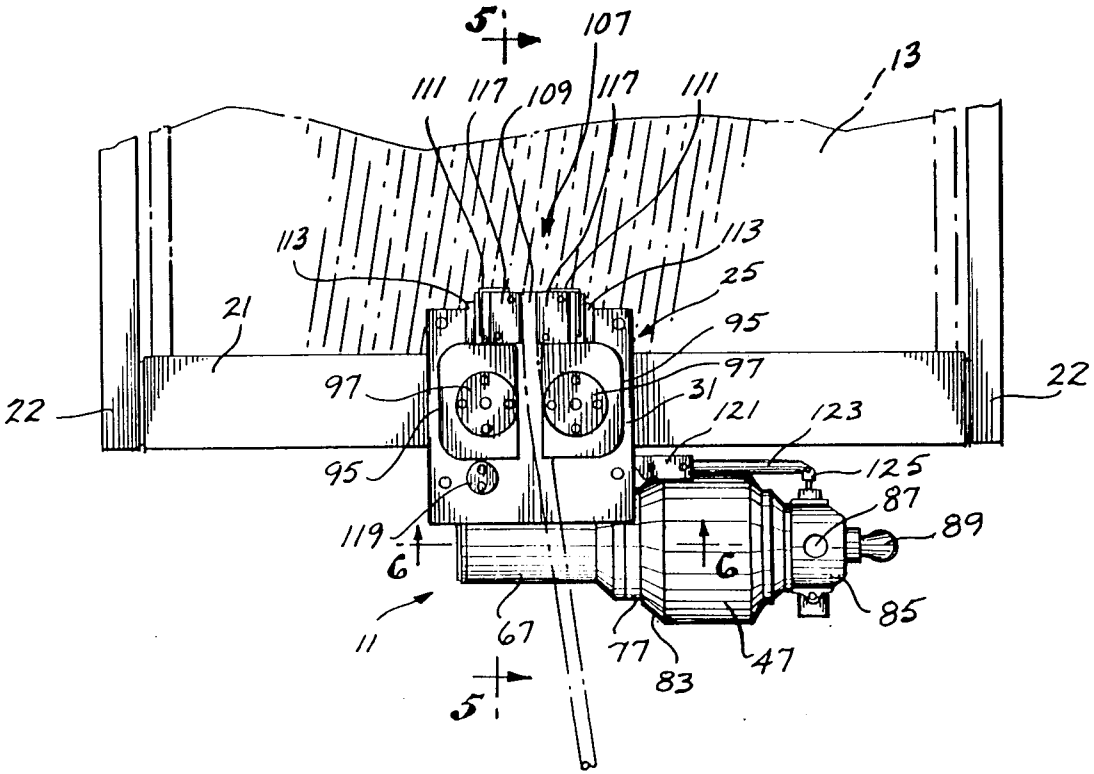
FIG. 3 is a top view of the levelwind mechanism illustrated in FIGS. 1 and 2.

FIGS. 1–3 illustrate a levelwind mechanism 11 formed in accordance with the invention. In order for the levelwind mechanism 11 to be better understood, a winch drum 13 is outlined in phantom in FIGS. 1 and 2. FIG 1 illustrates the path of travel of a cable 15 through the levelwind mechanism 11 onto the winch drum 13.

The levelwind mechanism 11 illustrated in FIGS. 1–3 includes a horizontally oriented square guide bar 21 formed of a square tube manufactured from a suitably strong material, e.g., iron or steel. The guide bar 21 is affixed to and supported by sidewalls 22 that form part of the winch framework. The sidewalls 22 also support the drum 13. The guide bar 21 may be welded or bolted to the sidewalls 22. Regardless how it is attached, the longitudinal axis of the guide bar 21 is positioned so as to lie parallel to the axis of rotation of the winch drum 13.

Affixed to the lower surface of the square guide bar 21 is a rack 23. The rack 23 may be welded to the guide bar 21, for example. The guide bar 21 and rack 23 are encircled by a frame 25. The frame 25 includes front and rear plates 27 and 29, a top plate 31 and a bottom plate 33. The front and rear plates 27 and 29 are generally rectangular and include flanges 35 that extend outwardly along their upper edges. The upper plate 31 is flat and attached to the outwardly extending flanges 35 by bolts 37. Spacers 39 are mounted on the bolts 37, between the outwardly extending flanges 35 of the front and rear plates 27 and 29, and the upper plate 31. The bottom plate 33 includes downwardly extending flanges 41 that are attached to the front and rear plates 27 and 29 by bolts 43.

The front and rear plates 27 and 29 and the top and bottom plates 31 and 33 define a cavity 34 through which the guide bar 21 passes. The width of the cavity 34, i.e., the distance between the front and rear plates 27 and 29, is slightly greater than the width of the square guide bar 21. The height of the cavity, i.e, the distance between the upper and lower plates 31 and 33, is substantially greater than the height of the square guide bar 21. As illustrated in FIG. 1, the square guide bar 21 is located at the top of the cavity 34.

Figure 4:
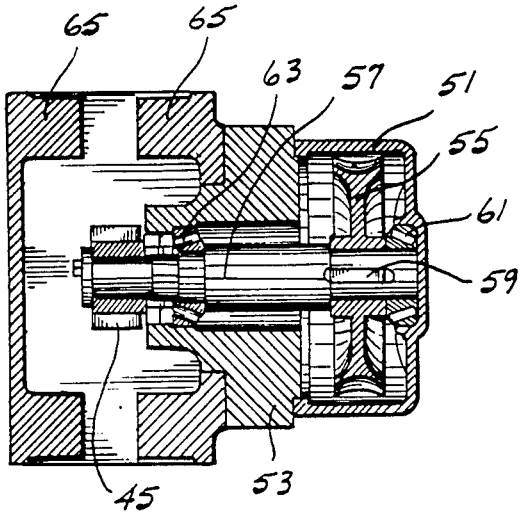
FIG. 4 is a cross-sectional view along line 4—4 of FIG. 1.

Located in the cavity, beneath the guide bar 21, is a pinion 45. The pinion 45 engages the rack 23 and is connected to an air motor 47 via a gear train 49. The gear train 49 includes a gear housing 51 mounted on an adaptor 53 that is mounted on the outer face of the rear plate 29. Mounted in the gear housing 51 is a worm gear 55 (FIG. 4). More specifically, the worm gear 55 is mounted on one end of a stub shaft 57 and is affixed thereto by a key 59. The pinion 45 is mounted on the other end of the stub shaft 57. The stub shaft 57 is rotatably mounted in a pair of bearings 61 and 63, one located in the gear housing 51 and the other located in the adaptor 53. Preferably, the front and rear plates 27 and 29 are each stiffened by a boss 65 that extends inwardly from and surrounds the region where the pinion 45 is located. The bosses 65 are separated by a distance adequate for the rack 23 to pass between the bosses.

Figure 6:
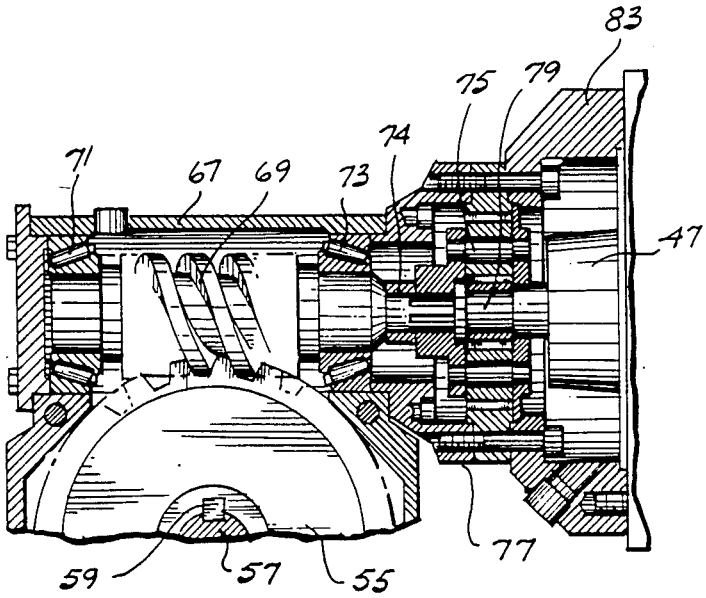
FIG. 6 is a cross-sectional view along line 6—6 of FIG. 3.

Mounted on the gear housing 51 is a worm housing 67. As illustrated in FIG. 6, the worm housing 67 houses a worm shaft 69 sized and positioned such that teeth of the worm shaft engage the teeth of the worm gear 55. The worm shaft 69 is rotatably supported at either end by bearings 71 and 73.

The air motor 47 is attached to the worm shaft 69 via a planetary gear reduction assembly 75, which is mounted in a reduction housing 77. The planet gears of the planetary gear reduction assembly 75 are connected to one end 74 of the worm shaft 69. Preferably, the coupling is a spline coupling. The sun gear of the planetary gear reduction assembly 75 is keyed to the output shaft 79 of the air motor 47. An adaptor 83, located between the housing of the air motor 47 and the reduction housing 77, encloses the connection between the air motor 47 and the planetary gear reduction assembly 75 and prevents contaminants from entering the planetary gear reduction assembly.

Mounted on the end of the air motor 47 remote from the planetary gear reduction assembly 75 is a control valve assembly 85. The control valve assembly 85 includes a conventional pneumatic control valve having an air inlet 87 and an air exhaust 89. In a conventional manner, the control valve 85 controls the magnitude and direction of pressurized air flow to the air motor 47. Thus, the control valve controls the speed and direction of rotation of the shaft 79 of the air motor 47.

As will be readily appreciated from the foregoing description, when the control valve applies pressured air to the air motor 47, the shaft 79 of the air motor rotates in one direction or the other. Air motor shaft rotation causes the worm shaft 69 to rotate. Rotation of the worm shaft 69 causes the worm gear 55 to rotate, resulting in rotation of the pinion 45. Because the teeth of the pinion 45 engage the teeth of the rack 23, rotation of the pinion 45 causes the frame 25 to longitudinally move along the guide bar 21. Sliding friction is minimized by a plurality of friction pads 91 located between the guide bar 21 and the elements that surround and are proximate to the guide bar. More specifically, friction pads 91 are affixed to the top of the bosses 65 that protrude inwardly from the front and rear plates 27 and 29. Friction pads 91 are also affixed to the front and rear plates 27 and 29 and the guide bar 21. Additional friction pads 91 are attached to the bottom of spacers 93 located at the outer ends of the upper plate 31. The friction pads are formed of a suitably strong low friction material. They may be formed of a hard plastic impregnated with graphite, for example.

Figure 5:
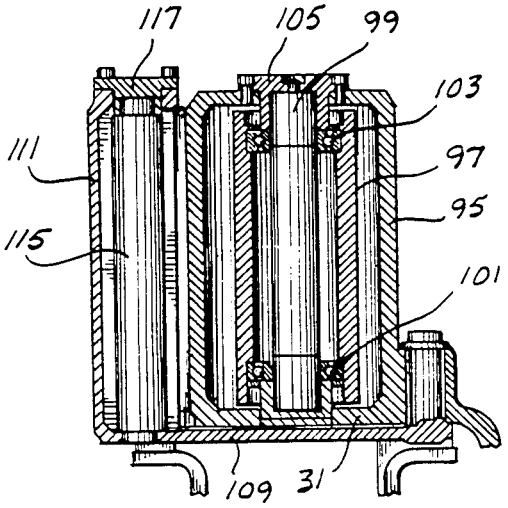
FIG. 5 is a cross-sectional view along line 5—5 of FIG. 3.

Mounted atop the upper plate 31 are right and left housings 95 within which are mounted relatively long cable rollers 97. More specifically, as illustrated in FIG. 5, the cable rollers 97 are rotatably mounted on vertically oriented shafts 99 that extend upwardly from the top of the upper plate 31. The shafts 99 support upper and lower bearings 101 and 103 on which the cable rollers 97 are mounted. A plate 105 attaches the upper end of the shafts 99 to the housings 95. The housings 95 are generally U-shaped when viewed from above. The open sides of the U's face one another and the shafts 99 are positioned such that the cable rollers 97 are spaced apart. The cable 15 passes between the high cable rollers 97.

Figure 7:
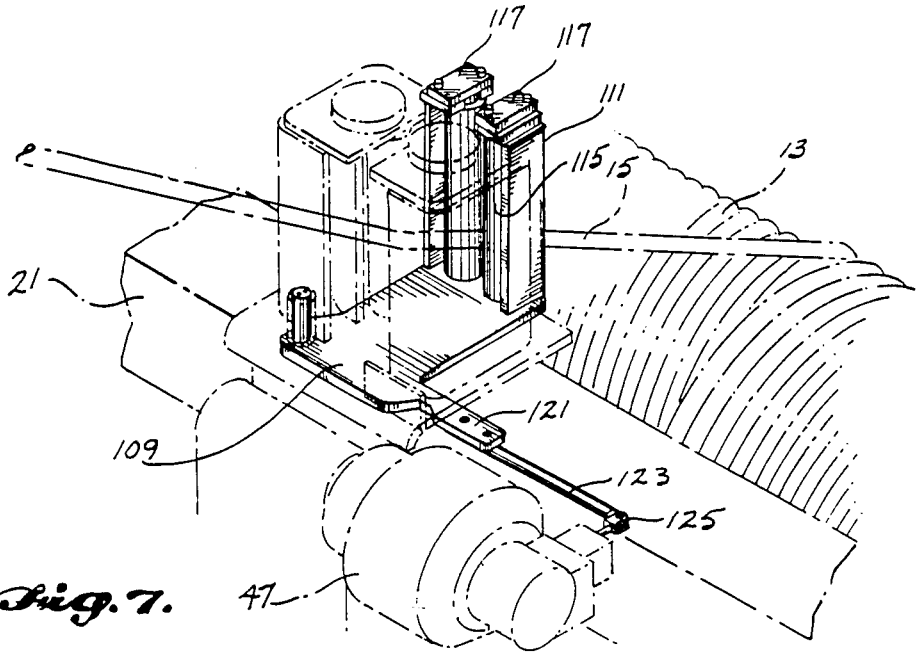
FIG. 7 is an isometric view of the fleet angle sensor mechanism included in the embodiment of the invention illustrated in FIGS. 1–6.

Energization of the air motor 47 is controlled by a fleet angle sensor 107. As best illustrated in FIG. 7, the fleet angle sensor includes a base plate 109 that lies in a small, flat cavity defined by the top of the guide bar 21, the bottom of the upper plate 31 of the frame 25, and the facing edges of the spacers 93 attached to the bottom of the upper plate 31.

Extending upwardly from the base plate 109 are a pair of angle brackets 111. The angle brackets lie in a rectangularly-shaped indentation formed in the edge of the top plate 31 that generally faces the drum 13. Extending upwardly from the upper plate 31 on either side of the rectangularly-shaped indentation are stop plates. The stop plates have inwardly extending protrusions (not shown) that limit the amount of travel of the angle brackets 111. The protrusions may be bolts, for example. Since the angle brackets lie between the U-shaped housings 95 and the drum 13, the angle brackets 111 lie between the cable rollers 97 and the drum 13.

Mounted in each of the angle brackets is a vertically oriented fleet angle finger 115. The lower ends of the fleet angle fingers 115 are mounted in holes formed in the base plate 109. The upper ends of the fleet angle fingers 115 are mounted in plates 117 attached to the upper ends of the angle brackets 111. The fleet angle fingers 115 are relatively long and spaced from one another by a distance that is slightly greater than the thickness of the cable and the cable 15 passes between the fingers 115. Thus, as it is being spooled, the cable 15 passes first between the guide rollers 97 and then between the fleet angle fingers 115. While the illustrated fingers are nonrotatable, they could be rotatable, if desired.

Extending upwardly from a corner of the plate 109 along the edge remote from the fleet angle fingers 115 is a shaft 119. The shaft 119 is rotatably mounted in a hub 127 that is formed in the top of the upper plate 31. The plate 109 includes an arm 121 that extends outwardly from the same edge. More specifically, the shaft 119 lies in one corner of the plate and the arm 121 protrudes outwardly from the other corner. When the plate 109 is positioned in the heretofore described small, flat cavity, the arm 121 lies parallel to the guide bar 21 and extends toward the control valve 85. The arm 121 is attached to the control valve 85 by a lever 123 and a clevis 125 (FIG. 3).

As will be readily appreciated from the foregoing description, the plate 109 is free to rotate about a vertical axis defined by the shaft 119. Movement of the plate 109 is controlled by pressure applied to the fleet angle fingers 115 by the cable 15. More specifically, when the cable 15 applies pressure against one or the other of the fleet angle fingers 115, the plate 109 is rotated in one direction or the other about the axis of the shaft 119. This causes the arm 121 to move the lever 123 toward or away from the control valve 85. This movement causes the movable element of the control valve 85 to move away from its quiescent position and apply pressurized air to the air motor 47. The direction of motor shaft rotation is dependent upon whether the lever arm 123 is moved toward or away from the control valve 85. In any event, the resulting rotation of the motor shaft results in the rotation of the worm shaft 69 and, thus, the pinion 45. Rotation of the pinion 45 causes the movement of the frame and, thus, the cable rollers 97. Thus, the direction of movement of the plate 109 controls the direction of movement of the cable rollers 97. In accordance with the invention, the direction of movement is such that the fleet angle is reduced.

In summary, when the fleet angle increases above a predetermined value, the air motor is energized, resulting in the fleet angle being reduced to an acceptable value. In this way, the cable 15 is evenly spooled onto the drum 13. Because both the fleet angle rollers and the cable rollers are relatively long, there is no need to provide a mechanism for laterally moving the guide bar 21 as cable is spooled.

As will be readily appreciated from the foregoing description, the invention provides a levelwind mechanism that is ideally suited for use in connection with heavy duty hoists. Because the levelwind mechanism is controlled by fleet angle, rather than by drum rotation, even spooling is provided. Because the coupling mechanism between the drive motor that moves the side rollers of the levelwind mechanism is a gear arrangement and because the guide bar is fixed, the invention is ideally suited for use in heavy industrial and commercial environments.

While a preferred embodiment of the invention has been illustrated and described, it is to be understood that various changes can be made therein without departing from the spirit and scope of the invention. For example, if desired, an electric motor can be used in place of an air motor. Hence, within the scope of the appended claims, the invention can be practiced otherwise than as specifically described herein.

The embodiments of the invention in which an exclusive property or privilege is claimed are defined as follows:

1. A levelwind mechanism for controlling the fleet angle of a cable as the cable is spooled onto a winch drum comprising:

a winch frame having sidewalls at the ends of said winch drum for rotatably supporting the winch drum;

a rigid guide bar rigidly attached to said sidewalls of said winch frame so as to lie parallel to the axis of rotation of said winch drum;

an elongate rack mounted on said rigid guide bar;

a frame slidably mounted on said rigid guide bar for movement along the guide bar, said slidably mounted frame being entirely supported by said rigid guide bar;

a motor mounted on said slidably mounted frame, said motor being entirely supported by said slidably mounted frame and, thus, said rigid guide bar;

a gear train mounted on said slidably mounted frame for coupling said motor to said rack, said gear train being entirely supported by said slidably mounted frame and, thus, said rigid guide bar, said gear train including: (i) a worm directly connected to the shaft of said motor; (ii) a shaft; (iii) a worm gear mounted on said shaft so as to engage said worm; and, (iv) a pinion gear mounted on said shaft and positioned to engage said rack;

cable guide rollers mounted on said slidably mounted frame through which cable passes as cable is spooled onto said winch drum, said cable guide rollers being entirely supported by said slidably mounted frame and, thus, said rigid guide bar; and, a fleet angle sensor mounted on said slidably mounted frame on the winch drum side of said cable guide rollers for sensing the fleet angle of cable as cable is spooled onto said winch drum, said fleet angle sensor being entirely supported by said slidably mounted frame and, thus, said rigid guide bar, said fleet angle sensor connected to said motor for controlling the energization of said motor such that said motor is energized to reduce said fleet angle when said fleet angle exceeds a predetermined value by rotating said gear train in the direction that causes said slidably mounted frame to slide in the direction that reduces said fleet angle.

2. A levelwind mechanism as claimed in claim 1 wherein said motor is an air motor.

3. A levelwind mechanism as claimed in claim 1 wherein said fleet angle sensor includes: a rotatable plate; fleet angle fingers mounted on said rotatable plate and positioned such that cable passes through said fingers as cable is spooled onto said winch drum and such that lateral pressure applied by said cable against said fingers rotates said plate; and, coupling means for coupling said plate to said motor so as to control the energization of said motor.

4. A levelwind mechanism as claimed in claim 3 wherein said motor is an air motor.

5. A levelwind mechanism as claimed claim 1 wherein said guide bar is rectangular and said elongate rack is mounted on the bottom side of said guide bar.

6. A levelwind mechanism as claimed in claim 5 wherein said slidably mounted frame surrounds said guide bar.

7. A levelwind mechanism as claimed in claim 6 wherein said slidably mounted frame comprises front and rear plates and top and bottom plates.

8. A levelwind mechanism as claimed in claim 7 wherein said motor and said gear train are mounted on said rear plate of said slidably mounted frame.

9. A levelwind mechanism as claimed in claim 8 wherein said cable guide rollers are mounted on said top plate of said slidably mounted frame.

10. A levelwind mechanism as claimed in claim 9 wherein said fleet angle sensor includes: a rotatable plate; fleet angle fingers mounted on said rotatable plate and positioned such that cable passes through said fingers as cable is spooled onto said winch drum and such that lateral pressure applied by said cable against said fingers rotates said plate; and, coupling means for coupling said plate to said motor so as to control the energization of said motor.

11. A levelwind mechanism as claimed in claim 10 wherein said motor is an air motor.

* * * * *